US006202387B1

(12) United States Patent
Brown et al.

(10) Patent No.: US 6,202,387 B1
(45) Date of Patent: Mar. 20, 2001

(54) APPARATUS AND METHOD FOR BANDING WRAPPED SILVERWARE

(75) Inventors: William Edward Brown, Nashville; Dwight Clanton, Shelbyville, both of TN (US); Reginald M. Mudd, 503 Dawn Pl., Lebanon, TN (US) 37087; Charles Woodard Gray, Gallatin, TN (US)

(73) Assignee: Reginald M. Mudd, Lebanon, TN (US); a part interest ( * ) Notice: Subject to any disclaimer, the term of this patent is extended or adjusted under 35 U.S.C. 154(b) by 0 days.

(21) Appl. No.: 09/388,779

(22) Filed: Sep. 2, 1999

Related U.S. Application Data

(63) Continuation-in-part of application No. 09/188,814, filed on Nov. 9, 1998, now Pat. No. 6,023,913.

(51) Int. Cl.[7] ..... B65B 51/04

(52) U.S. Cl. ..... 53/419; 53/137.2; 53/590; 156/538

(58) Field of Search ..... 53/419, 137.2, 53/590, 399, 461, 465, 148, 154, 587, 209, 211, 216, 218, 219, 118, 119, 430; 156/492, 490, 538

(56) References Cited

U.S. PATENT DOCUMENTS 4,601,154 * 7/1986 Ausnit ..... 53/430
5,237,801 * 8/1993 Hillam et al. ..... 53/238
5,428,941 * 7/1995 Staub ..... 53/399
5,469,688 * 11/1995 Dunbar ..... 53/419
5,614,042 * 3/1997 Nishide et al. ..... 53/137.2

* cited by examiner

*Primary Examiner*—Linda Johnson
(74) *Attorney, Agent, or Firm*—Michael E. McKee

(57) ABSTRACT

An apparatus and method for banding a wrapped silverware arrangement with a two-sided segment of banding material bearing a treatable adhesive on one side thereof utilizes a pair of jaw members which are movable between open and closed conditions for capturing a wrapped silverware arrangement and a clamp assembly for releasably holding an end of a banding material segment. With an end of the banding material segment held by the clamp assembly and the jaw members being disposed in an open condition, the jaw members are lowered onto a wrapped silverware arrangement so that the banding material segment is draped across the wrapped silverware arrangement and so that subsequent movement of the jaw members to the closed condition captures the silverware arrangement between the jaw members and positions the banding material segment in an inverted U-shaped orientation about the wrapped silverware arrangement. The one end of the banding material segment is thereafter released from the clamp assembly and exposed to heat to render the adhesive borne by one region of the segment tacky. The wrapped silverware arrangement is thereafter rotated about its longitudinal axis so that the tacky region of adhesive is moved into contact with another surface region of the banding material segment so that the banding material segment is thereby secured in a band about the wrapped silverware arrangement.

14 Claims, 7 Drawing Sheets

APPARATUS AND METHOD FOR BANDING WRAPPED SILVERWARE

This invention is a continuation-in-part application of U.S. patent application Ser. No. 09/188,814 filed Nov. 9, 1998, entitled APPARATUS AND METHOD FOR WRAPPING SILVERWARE WITHIN A NAPKIN, now U.S. Pat. No. 6,023,913, and the disclosure of which is incorporated herein by reference.

BACKGROUND OF THE INVENTION

This invention relates generally to the preparation of table settings for use in the food service industry and relates, more particularly, to the means and methods for banding a wrapped arrangement of silverware for use in a place setting.

In the food service industry, a great deal of time is normally devoted to the wrapping of silverware (i.e. also referred to in the art as eating utensils or flatware) within a napkin for use in a table setting. Of course, by simply winding items of silverware within a napkin does not ordinarily place the arrangement in a condition which prevents the napkin from inadvertently unwrapping from the silverware unless the wound arrangement is carefully handled. Preferably, therefore, the wound silverware arrangement is banded with a piece of tape or some other segment of banding material which encircles the wrapped arrangement along its longitudinal axis and thereby binds and maintains the arrangement in a wrapped condition.

In our above-referenced pending U.S. patent application Ser. No. 09/188,814 filed Nov. 9, 1998, we describe a silverware-wrapping apparatus which employs a worktable within which is provided an upwardly-opening trough for accepting a napkin and silverware items positioned therein. The napkin is automatically placed over the opening of the trough in a spread condition and then silverware items are automatically directed onto the napkin so that the silverware falls to the bottom of the trough thereby positioning the napkin between the silverware and the bottom of the trough. A pair of rotatable blades is positioned within the trough for automatically spinning the napkin and silverware items about the longitudinal axis of the trough until the napkin and silverware items are wound in a wrapped arrangement. However, no means are described in connection with that wrapping apparatus for banding the wrapped silverware.

Accordingly, it is an object of the present invention to provide a new and improved means and method for banding wrapped silverware.

Another object of the present invention is to provide such a means which is well-suited for banding wrapped silverware while the wrapped silverware is positioned within the worktable trough of the wrapping apparatus described in our referenced patent application.

Still another object of the present invention is to provide such a means whose banding operation is automatic and is capable of banding wrapped silverware relatively quickly.

Yet another object of the present invention is to provide such a means which is uncomplicated in construction yet effective in operation.

SUMMARY OF THE INVENTION

This invention resides in an apparatus and method for banding a wrapped silverware arrangement with a two-sided segment of banding material bearing an adhesive on one side thereof which must be appropriately treated in order that the adhesive is rendered tacky and thereby capable of adhering to a surface against which the adhesive-bearing side of the segment is placed into contact, and wherein the wrapped silverware arrangement includes at least one item of silverware which has been wound within a napkin into a wrapped arrangement of elongated form.

The apparatus of the invention includes a frame and a jaw assembly supported by the frame. The jaw assembly includes opposing jaw members which are joined together to accommodate movement of the jaw members relative to one another between an open condition at which the jaw members define an open mouth through which the wrapped silverware arrangement can be moved sideways into a position between the jaw members and a closed condition at which the wrapped silverware arrangement is captured between the jaw members in a manner which permits the wrapped arrangement to be rotated about its longitudinal axis while in its captured condition. Means are connected to the jaw assembly for moving the jaw members between the open and closed conditions, and clamp means are joined to the jaw assembly for releasably holding a segment of banding material adjacent the jaw assembly. To this end, the clamp means includes opposing clamp members which are movable toward and away from one another between an open condition at which an end of the banding material segment can be accepted between the clamp members and a closed condition at which the end of the banding material segment is clamped therebetween. Means are also associated with the clamp means for moving the clamp members of the clamp means between the open and closed conditions.

The apparatus further includes means disposed at a first station for introducing an end of the banding material segment between the clamp members when the clamp members are in the open condition so that by subsequently moving the clamp members to the closed condition, the end of the banding material segment is held between the clamp members. In addition, there is provided means for moving the jaw assembly, with its jaw members arranged in the open condition and one end of a banding material segment held between the clamp members, from the first station and onto the wrapped silverware arrangement so that the banding material segment is draped across the wrapped silverware arrangement and so that subsequent movement of the jaw members to the closed condition captures the silverware arrangement between the jaw members and positions the banding material segment in a U-shaped orientation, or arrangement, about the wrapped silverware arrangement and the subsequent release of the banding segment by the clamp members places the one end of the banding material segment in an exposed condition. Also included in the apparatus is means for treating a region of adhesive borne by one side of the exposed end of the banding material segment to render the adhesive of the region tacky and so that subsequent rotation of the wrapped silverware arrangement about its longitudinal axis moves the tacky region of adhesive into contact with another surface region of the banding material segment so that the banding material segment is secured to itself in a band wound about the wrapped silverware arrangement.

The method of the invention includes the steps performed by the apparatus of the invention. More specifically, an end of the banding material segment is introduced between the clamp members at a first station when the clamp members are in the open condition and the clamp members are subsequently moved to the closed condition so that the end of the banding material segment is held between the clamp members. The jaw assembly is thereafter moved, while its jaw members are arranged in the open condition and one end of a banding material segment is held between the clamp members, from the first station to a second station at which the jaw assembly is moved onto the wrapped silverware arrangement so that the banding material segment is draped across the wrapped silverware arrangement. The jaw members are subsequently moved to the closed condition so that the silverware arrangement is captured between the jaw members and the banding material segment is positioned in a U-shaped orientation about the wrapped silverware arrangement. In addition, the clamp members are moved to the open condition to release the banding material segment from the clamp members and thereby place the one end of the banding material segment in an exposed condition. A region of adhesive borne by one side of the exposed end of the banding material segment is thereafter treated to render the adhesive of the region tacky, and the wrapped silverware arrangement is subsequently rotated about its longitudinal axis so that the tacky region of adhesive is moved into contact with another surface region of the banding material segment so that the banding material segment is secured to itself in a band about the wrapped silverware arrangement.

DETAILED DESCRIPTION OF THE ILLUSTRATIVE EMBODIMENTS

Figure 1:
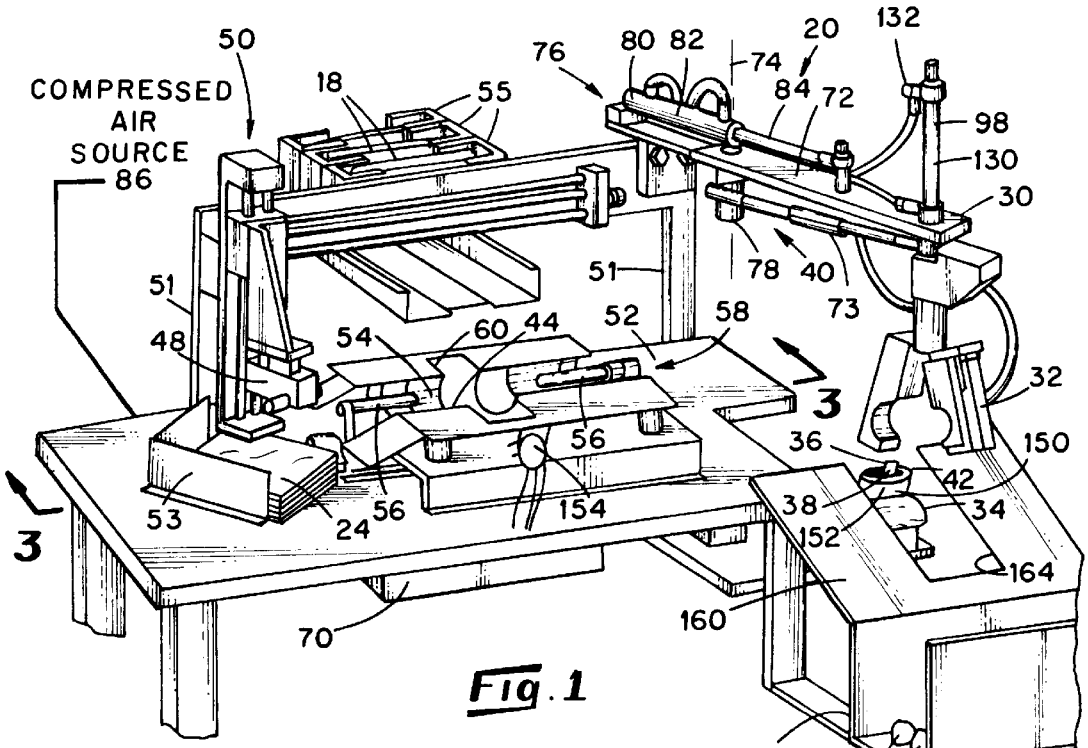
FIG. 1 is a perspective view of a silverware wrapping apparatus and an embodiment of a banding apparatus with which the steps of the invention can be carried out wherein the jaw assembly of the banding apparatus is shown positioned adjacent one station of the apparatus.

Turning now to the drawings in greater detail, there is shown in FIG. 1 an embodiment, generally indicated 20, of an apparatus for banding a wrapped arrangement 22 (FIG. 2) of silverware and thereby binding the wrapped silverware arrangement 22 in a wrapped condition. The silverware arrangement 22 capable of being banded by the FIG. 1 embodiment 20 includes one or more items of silverware 18 (e.g. fork, knife or spoon) and a napkin 24 which is wound around the silverware items 18 to provide an elongated arrangement 22 having two opposite ends and a longitudinal axis 26 extending between the two opposite ends.

With reference again to FIG. 1, the banding embodiment 20 includes a frame 30, a jaw assembly 32 supported by the frame 30, dispensing means in the form of a dispensing assembly 34 for introducing a segment, indicated 36, of banding material 38 to the jaw assembly 32 and moving means 40 for moving the jaw assembly 32 between a first station 42 at which the banding material segment 36 is picked up from the dispensing assembly 34 and a second station 44 at which the wrapped silverware arrangement 22 is banded with the segment 36 and thereby secured around the wrapped silverware arrangement 22 in a wound condition.

Figure 2:
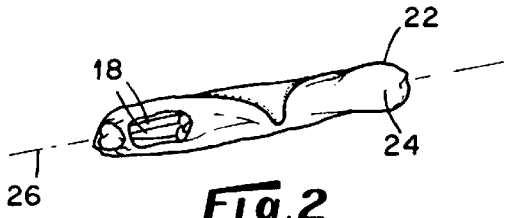
FIG. 2 is a perspective view, shown partially cut-away, of a wrapped napkin arrangement which is capable of being banded by the banding apparatus of FIG. 1.

There is also illustrated in FIG. 1 an embodiment, generally indicated 50, of a silverware wrapping apparatus for wrapping one or more items of silverware 18 within a napkin 24 to render a wrapped silverware arrangement 22 as illustrated in FIG. 2. The wrapping apparatus 50 has been described in detail in our co-pending patent application Ser. No. 09/188,814, filed Nov. 9, 1998, so that a detailed description of the apparatus 50 is not believed to be necessary. Briefly, however, the silverware wrapping apparatus 50 includes a frame 51 and a worktable 52 supported by the frame 51 defining an upwardly-opening, elongated trough 54. The worktable 52 is the site, or station, to which a napkin and silverware are delivered, and the trough 54 is the site, or station, at which a napkin-wrapping operation is carried out. A napkin storage bin 53, from which napkins are transported one-at-a-time to the worktable 52, is disposed at one end of the apparatus 50, and silverware storage bins 55 are supported to one side of and in an elevated condition relative to the worktable 52 for storing silverware items 18 before the items are delivered to the worktable 52.

During operation of the apparatus 50, a napkin 24 is automatically removed (by suitable pick-up means 48) from the top of the stack of napkins positioned in the storage bin 53 and placed in a spread condition upon the surface of the worktable 52 so as to span the width of the trough 54, and then the silverware items 18 are gravitationally directed from the storage bins 55 and onto the portion of the napkin which directly overlies the trough 54. When the silverware items 18 fall upon the napkin 24, the napkin falls into the trough 54 under the weight of the silverware items. For effecting the wrapping of the silverware items positioned within the trough 54, the apparatus 20 includes a pair of rotatable blades 56 (best shown in FIG. 3) positioned in an end-to-end relationship within the trough 54 and associated napkin-spinning means 58 for rotating the blades 56 about the longitudinal axis of the trough 54 so that the napkin 24 and silverware items 18 are forced to rotate within the trough 54 into the desired wrapped arrangement of FIG. 2. The blades 56 are movable lengthwise into and out of the ends of the trough 54 so that when positioned within the trough 54, the blades 56 are positioned to one side of the trough 54 for acting upon the napkin and silverware items positioned therein, and so that when withdrawn from the trough 54, the blades 56 move out of engagement with the wound napkin to a retracted position at which the wound napkin can be acted upon by the banding apparatus 20 and subsequently removed from the trough 54. In this connection, the worktable 52 includes a cutout 60 which opens transversely across the trough 54 which, as will be apparent herein, permits the jaw assembly 32 to move into working relationship with a wrapped silverware arrangement 22 while the wrapped silverware arrangement 22 remains positioned within the trough 54.

Figure 3:
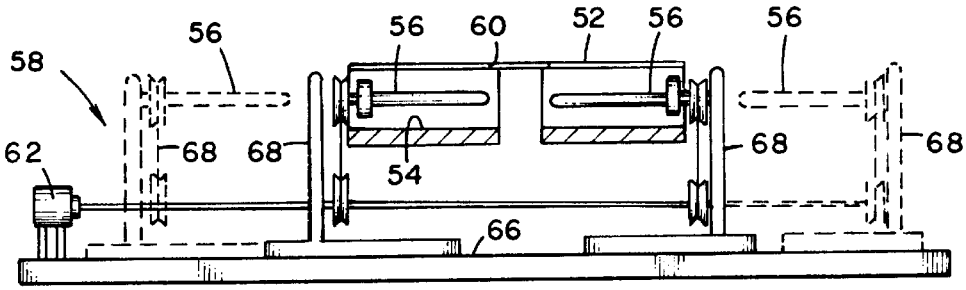
FIG. 3 is a longitudinal cross-sectional view of the worktable and napkin-spinning means of the FIG. 1 silverware-wrapping apparatus as seen along line 3—3 of FIG. 1.

With reference still to FIG. 3, the napkin-spinning means 58 used for rotating the blades 56 about the longitudinal axis of the trough 54 includes a servomotor 62 and associated belts and gears which slave the blades 56 to one another so that rotation of one blade 56 about the longitudinal axis of the trough 56 effects the rotation of the other blade 56, as well. In addition, the blades 56 are rotatably mounted upon carriage-supported pedestals 68 which are, in turn, mounted upon guideways 66 which accommodate movement of the blades 56 lengthwise along the length of the trough 54. Moving means, including air cylinders (not shown), are connected between the apparatus frame 51 and the pedestals 68 for moving the blades 56 lengthwise into and out of the trough 54. Control over the sequencing and operation of the various components, including valves associated with the air cylinders, is had by way of a controller 70 (FIG. 1) mounted beneath the worktable 52 and which includes an internal control computer and associated electronic components which are wired to the valves of the various cylinder assemblies for opening and closing the valves, when appropriate, to ensure that the operations of the various components are carried out in the proper sequence and actuates, when appropriate, the servomotor 62 of the napkin-spinning means 58.

For a more complete description of the apparatus 50, reference can be had to our co-pending patent application Ser. No. 09/188,814, filed Nov. 9, 1998, the disclosure of which is incorporated herein by reference.

As will be apparent herein, the banding apparatus 20 utilizes the rotatable blades 56 and the associated napkin-spinning means 58 for rotating the wrapped silverware arrangement 22 about the longitudinal axis of the arrangement 22 during a banding operation performed with the banding apparatus 20. Consequently, a banding operation is performed upon the wrapped silverware arrangement 22 while the arrangement 22 is positioned within the trough 54 and before the blades 56 are withdrawn lengthwise along the trough 54 and out of engagement with the wrapped silverware arrangement 22.

Figure 7:
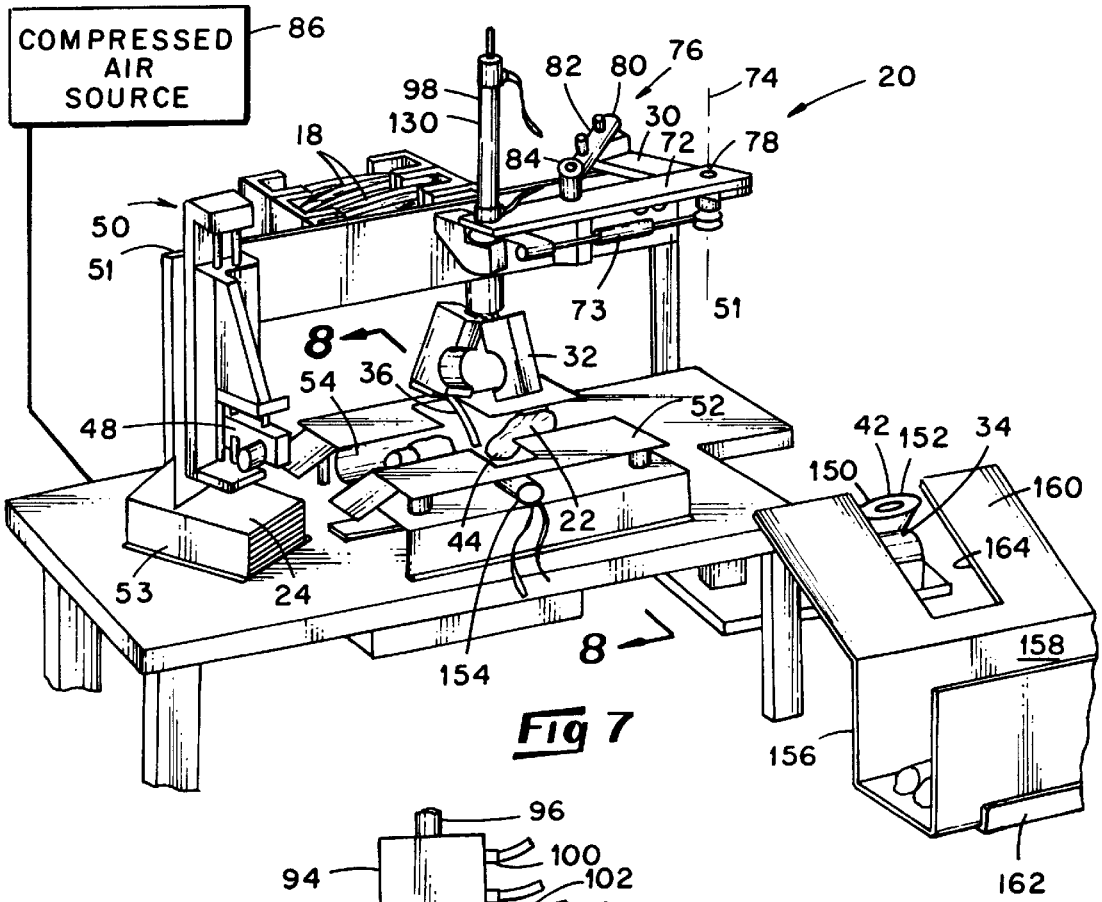
FIG. 7 is a view similar to that of FIG. 1 but illustrating the jaw assembly of the FIG. 1 banding apparatus when positioned adjacent another station in the apparatus.

With reference still to FIG. 1, the frame 30 of the banding apparatus 20 includes an arm member 72 which is pivotally attached (by means of a pin 78) to the frame 51 of the wrapping apparatus 50 for swinging movement relative thereto about a substantially vertical axis 74 between the position of the arm member 72 illustrated in FIG. 1 and the position of the arm member 72 illustrated in FIG. 7. The jaw assembly 32 described herein, is supported at the (free) end of the arm member 72 opposite the pin 78 so that by moving the arm member 72 along a horizontal path between the FIG. 1 and FIG. 7 positions, the jaw assembly 32 is moved between a position at which the jaw assembly 32 is disposed in vertical registry with the first station 42 and a position at which the jaw assembly 32 is disposed in vertical registry with the second station 44.

Also associated with the arm member 72 are air-powered moving means, generally indicated 76, for moving the arm member 72 between the FIG. 1 and FIG. 7 positions. The moving means 76 includes a horizontally-arranged double-acting air cylinder assembly 80 which is connected between the arm member 72 and the frame 30 for acting therebetween. More specifically, the cylinder assembly 80 includes a horizontally-arranged cylinder 82 which is pivotally anchored to the end of the frame 30 opposite the arm member 72 and a ram 84 which is slidably mounted within the cylinder 82 and pivotally secured to the arm member 72. By actuating the cylinder assembly 80 from a compressed air source 86, the free end of the arm member 72 is pivoted about the pivot axis 74 between its FIG. 1 and FIG. 7 positions.

The operation of a double-acting air cylinder assembly 80 is well known in the art so that a detailed description of its operation is not believed to be necessary. Suffice it to say that air from the source 86 is delivered to each end of the cylinder 82 (by way of suitable hoses) to pressurize each end thereof, and solenoid-actuated relief valves are associated with each end of the cylinder 82 to selectively relieve the internal pressure at the cylinder ends. Therefore, control over the movement of the ram 84 along the length of the cylinder 82 is had by controlling the actuation of the relief valves at each end of the cylinder 82. In other words, by selectively relieving the pressure within one end of the cylinder 82, the pressure of air contained within the opposite end of the cylinder 82 urges the ram 84 toward the one end. For controlling the operation of the cylinder assembly 80 (as well as the sequence of operation of the components of the apparatus 20), the command controller 70, introduced earlier, is appropriately wired to the relief valves associated with the cylinder assembly 80 for delivering command signals thereto.

Therefore and with reference still to FIGS. 1 and 7, by relieving air pressure contained within a selected end of the cylinder 82, the ram 84 withdraws into the cylinder 82 so that the arm member 72 is pivoted horizontally about the pivot axis 74 from the FIG. 1 position to the FIG. 7 position. Conversely, by relieving the air pressure contained within the opposite end of the cylinder 82, the ram 84 extends from the cylinder 82 so that the arm member 72 is pivoted horizontally about the pivot axis 74 from the FIG. 7 position to the FIG. 1 position.

Associated with the arm member 72 is a linkage member 73 which is appropriately (and pivotally) connected between the frame 30 and the jaw assembly 32 so that as the arm member 72 is moved from the FIG. 7 position to the FIG. 1 position, the jaw assembly 32 rotates through about 180° of movement. As will become apparent herein, this rotation of the jaw assembly 32 through 180° of movement positions an end of the segment 36 in condition to be appropriately worked upon (i.e. treated) following transport of the segment 36 to the second station 44.

Figure 4:
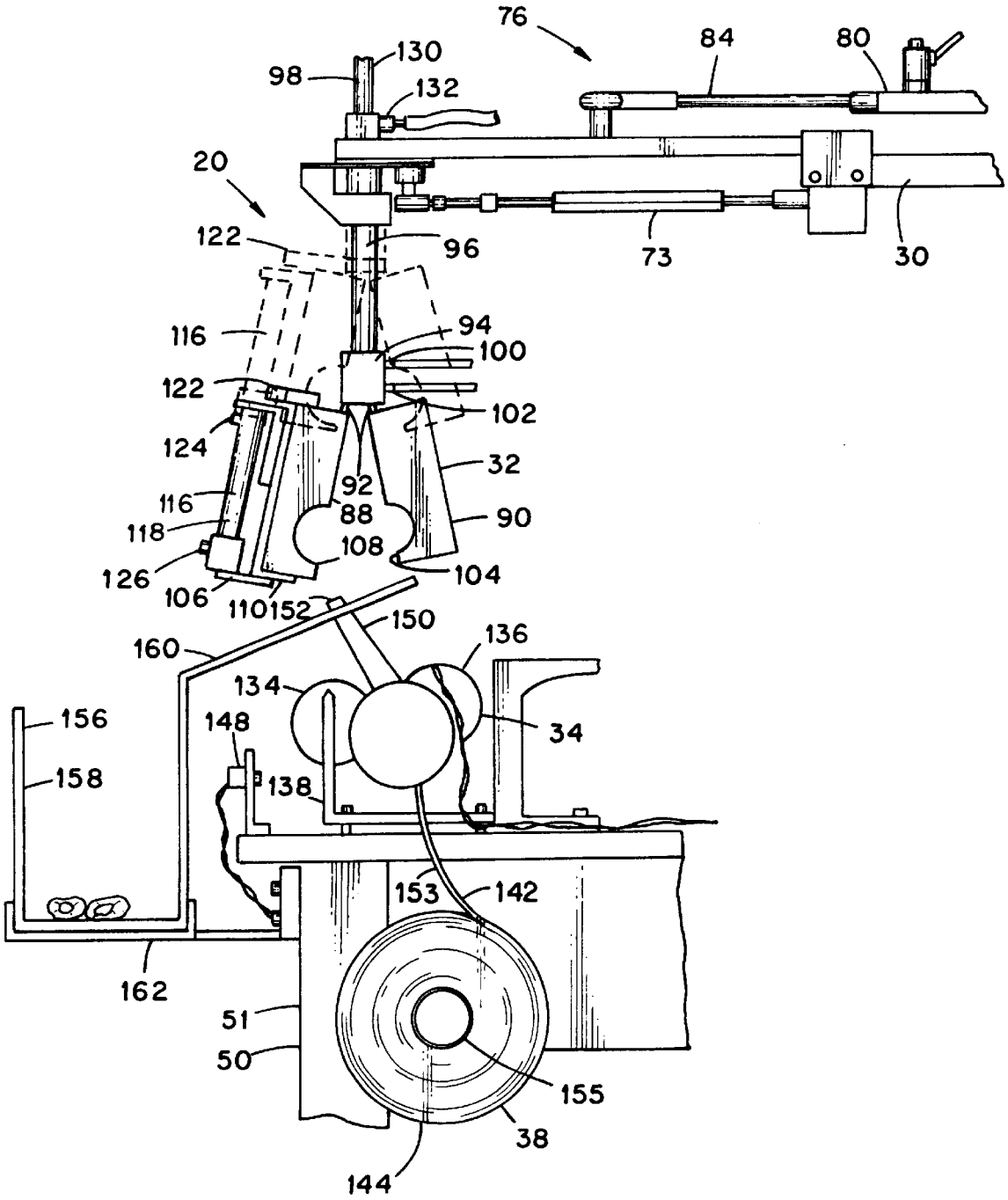
FIG. 4 is an end elevation view of the jaw assembly and banding material dispensing means of the FIG. 1 banding apparatus as seen generally from the right in FIG. 1.
Figure 5:
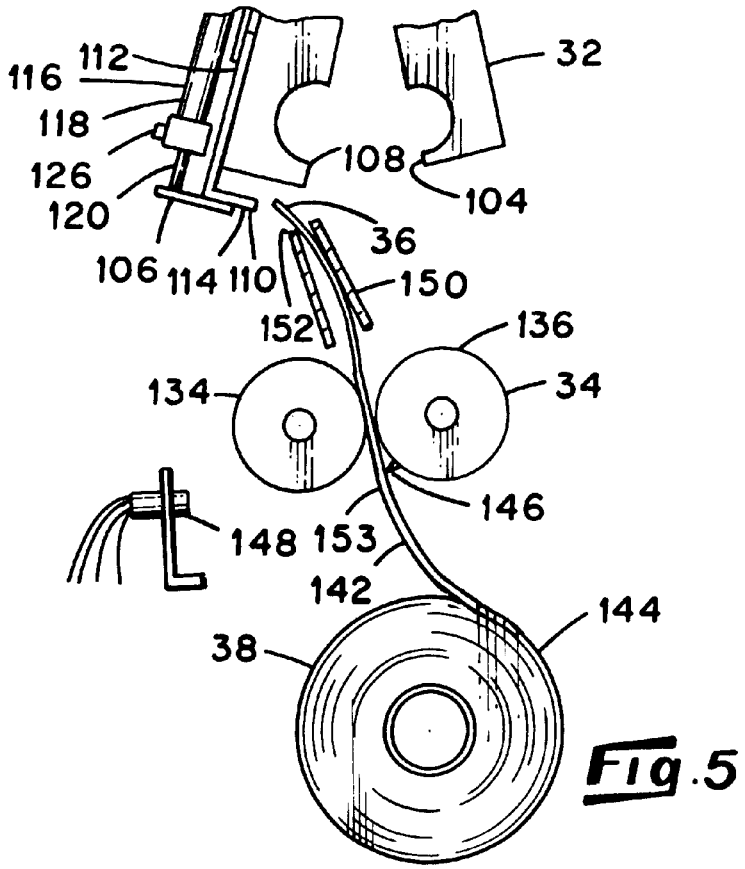
FIG. 5 is an end elevational view of a fragment of the banding material dispensing means of the FIG. 1 banding apparatus as shown in FIG. 4, but with the servomotor being removed therefrom and illustrating schematically the operation of the dispensing means.
Figure 10:
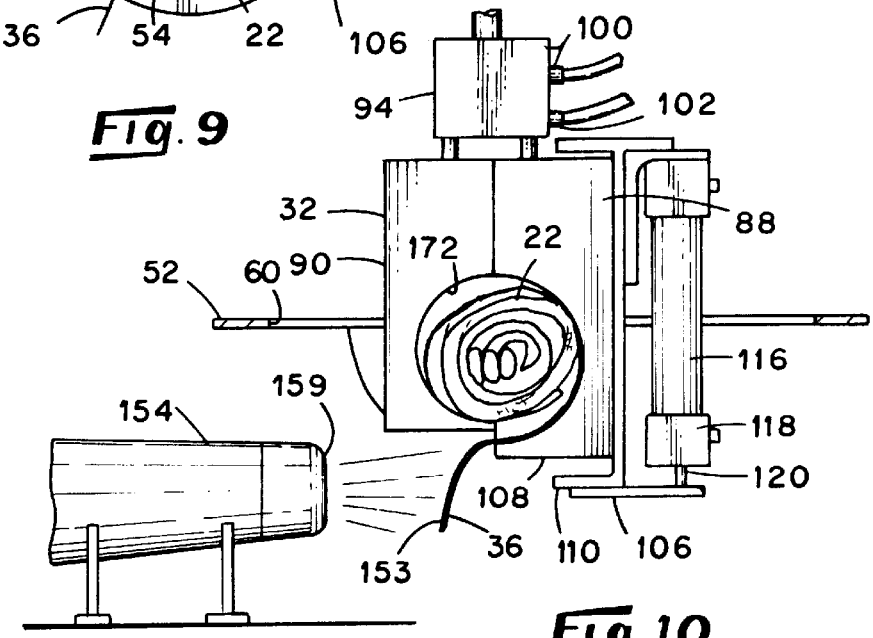

With reference to FIGS. 4, 5 and 10, the jaw assembly 32 includes a pair of jaw members 88, 90 having clamping, or engagement, surfaces of C-shaped cross section and which are pivotally attached to one another for movement between an open condition as illustrated in FIGS. 4 and 5 and a closed condition as illustrated in FIG. 10. Each jaw member 88 or 90 has upper and lower ends, and the jaw members 88, 90 are arranged so that the Cs of the C-shaped form of the members 88, 90 open toward one another. The upper ends of the jaw members 88, 90 are fixedly secured to the downwardly-depending ram members 92 of an air clamp 94 which, in turn, is fixedly supported by a ram member 96 of a double-acting air cylinder assembly 98 described herein. The air clamp 94 has an inlet port 100 through which air is directed into the interior of the clamp 94 for purposes of moving the (lower ends of the) jaw members 88, 90 toward one another to the closed condition of FIG. 10 and also includes a discharge port 102 through which air is permitted to exit the interior of the clamp 94. The jaw members 88, 90 are biased toward an open condition by way of a spring mounted internally of the clamp 94 so that when the air is permitted to exit the clamp interior by way of the discharge port 102, the lower ends of the jaw members 88, 90 are moved, under the influence of the internally-mounted spring, away from one another to the open condition illustrated in FIGS. 4 and 8. As will be apparent herein, the open jaw members 88, 90 are sized so as to provide a mouth 104 therebetween through which a wrapped silverware arrangement 22 is permitted to enter when the open jaw members 88, 90 are lowered downwardly thereover, and the Cs of the jaw members 88, 90 are sized so that when the jaw members 88, 90 are closed about the wrapped silverware arrangement 22, as illustrated in FIG. 10, the Cs of the jaw members 88, 90 define an opening 172 (FIG. 10) within which the wrapped silverware arrangement 22 is loosely captured so that the arrangement 22 can still be rotated about its longitudinal axis by means of the napkin-spinning means 58.

Also associated with the jaw assembly 32 is a clamp assembly 106 for releasably holding a segment 36 of banding material adjacent the jaw assembly 32 as the jaw assembly 32 is moved between the first and second stations 42 and 44. More specifically, the clamp assembly 106 includes opposing upper and lower clamp members 108, 110, respectively, wherein the upper clamp member 108 is provided by the lower surface of the jaw member 88 and the lower clamp member 110 includes an L-shaped piece having one leg 112 which is supported by the jaw member 88 for sliding movement (upwardly or downwardly) along the length thereof and has another leg 114 which is disposed beneath the lower surface of the jaw member 88. As the clamp member 110 is slidably moved relative to and along the jaw member 88 (by moving means described herein), the leg 114 of the clamp member 110 moves toward and away from the upper clamp member 108 between a lower position (as shown in FIG. 5) at which the clamp members 108 and 110 are spaced apart in an open condition and an upper position (as shown in FIG. 4) at which the clamp members 108 and 110 engage one another in a closed condition.

For moving the clamp members 108 and 110 between the open and closed conditions, there is provided a single-acting cylinder assembly 116 having a cylinder 118 which is secured in a fixed relationship to the jaw member 108 and a ram 120 which is movably mounted within the cylinder 118 for movement therealong. The cylinder 118 is joined to the jaw member 108 along one side thereof by means of a bracket 122, and the end of the ram 120 opposite the cylinder 118 is joined to the clamp member 110 so that movement of the ram 120 relative to and along the length of the cylinder 118 moves the clamp members 108, 110 between the open and closed conditions. The single-acting air cylinder assembly 116 includes an air inlet port 124 for receiving air under pressure from the compressed air source 86 and a discharge port 126 through which the pressurized air is permitted to escape the interior of the cylinder 118. A compression spring (not shown) mounted internally of the cylinder 118 acts between the cylinder 118 and the ram 120 so that upon release of the pressurized air from within the cylinder 118, the ram 120 is urged toward to one end of the cylinder 118 by the compression spring. Conversely, when the interior of the cylinder 118 is permitted to be pressurized under the influence of air from the source 86, the strength of the compression spring is overcome and the ram 120 is moved toward the opposite end of the cylinder 118.

The ram 120 is connected to the clamp member 110 so that pressurization of the cylinder 118 moves the clamp member 110 upwardly from the open condition of FIG. 5 to the closed condition illustrated in FIG. 4 while the release of the pressurized air from the cylinder 118 moves the clamp member 110 downwardly from the closed condition of FIG. 4 to the open condition of FIG. 5. As will be apparent herein, when the clamp members 108, 110 are in the open condition of FIG. 5, the clamp assembly 106 is in condition for accepting an end of the banding material segment 36 directed endwise therein by the dispensing assembly 34, and when closed about the end of the banding material segment 36, the clamp assembly 106 releasably holds the segment 36 between the clamp members 108, 110 for transport with the jaw assembly 32 from the first station 42 to the second station 44.

As mentioned earlier and with reference to FIGS. 1 and 4, the banding apparatus 20 includes a double-acting air cylinder assembly 98 mounted upon the frame 30 for moving the jaw members 88, 90 (and thus the jaw assembly 32) upwardly and downwardly relative to the arm member 72 at each of the first and second stations 42 and 44. To this end, the cylinder assembly 98 includes a cylinder 130 which is fixedly secured atop the arm member 72 in a vertical orientation, and the ram 96 of the assembly 98 is slidably received by the cylinder 130 and extends downwardly through an aperture provided in the arm member 72. The lower end of the ram 96 is fixedly secured to the air clamp 94 so that raising and lowering of the ram 96 relative to the cylinder 130 moves the clamp assembly 106 upwardly and downwardly by a corresponding amount. Because the cylinder assembly 98 is double-acting, air inlet ports 132 are mounted at each end of the cylinder 130 for receiving air, under pressure, from the compressed air source 86. By relieving air pressure through a relief valve mounted on a corresponding end of the cylinder 130, the ram 96 is moved upwardly or downwardly between raised and lowered positions. Again, control over the actuation of the cylinder assembly 98, and thus the position of the jaw assembly 32 relative to the arm member 72 is had by way of the controller 70 (FIG. 1) which is appropriately wired to the relief valves mounted at each end of the cylinder 130.

Figure 8:
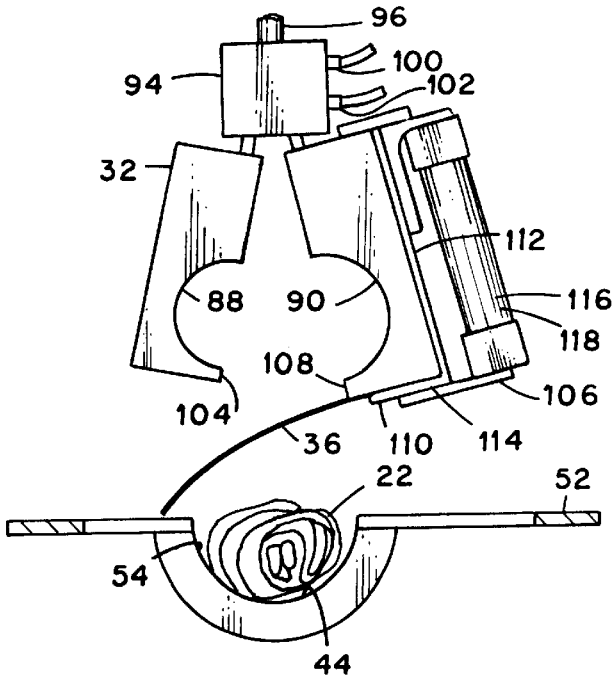
FIG. 8 is a traverse cross-sectional view of the jaw assembly and worktable as seen along line 8—8 of FIG. 7.
Figure 9:
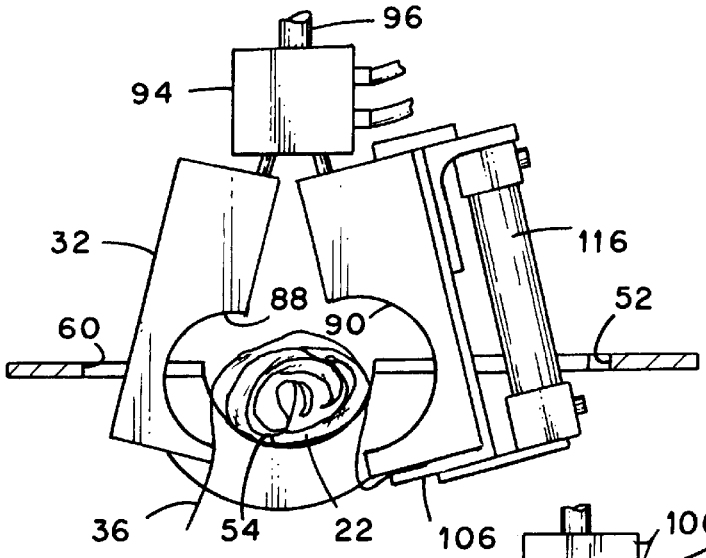
FIGS. 9–11 are views similar to that of FIG. 8 showing the relative positions of the jaw members of the jaw assembly at various stages of a silverware-banding operation.

During operation of the banding apparatus 20, the jaw assembly 32 is in a raised condition as it is moved horizontally with the arm member 72 between the first and second stations 42 and 44, and is raised and lowered at each of the first and second stations 42 and 44. More specifically, when positioned in the raised condition at the first station 42, the jaw assembly 32 is disposed in vertical registry with the dispensing assembly 34, and when positioned in the raised condition at the second station 44, the jaw assembly 32 is disposed in vertical registry with the trough 54 of the worktable 52. To pick-up a banding material segment 36 at the first station 42, the jaw assembly 32 is lowered from its raised condition (illustrated in phantom in FIG. 4) to its lowered condition (illustrated in solid lines in FIG. 4 and in FIG. 5). After clamping the end of the banding material segment 36 within the clamp assembly 106, the jaw assembly 32 is returned to the raised condition for subsequent movement to the second station 44. At the second station 44, the jaw assembly 32 is lowered from its raised condition (as illustrated in FIGS. 7 and 8) to a lowered position (as illustrated in FIG. 9) at which the jaw members 88, 90 are positioned on opposite sides of the wrapped silverware arrangement 22. After moving the jaw assembly 32 to the closed condition about the wrapped arrangement 22 and completing a banding operation (described herein), the jaw assembly 32, along with the banded silverware arrangement held thereby, is lifted to the raised condition of FIGS. 7 and 8 and thereafter returned to the first station 42.

Figure 6:
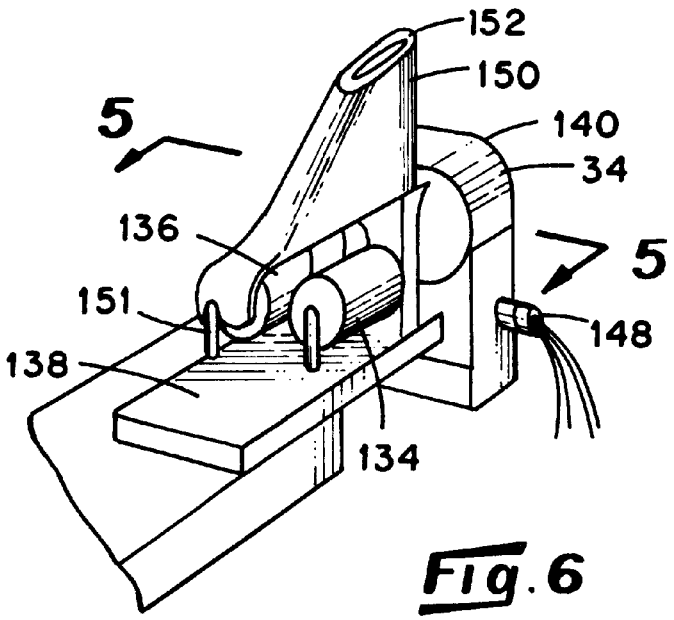
FIG. 6 is a perspective view of the banding material dispensing means of the FIG. 1 apparatus.

With reference to FIGS. 4–6, the dispensing assembly 34 for dispensing a segment 36 of banding material 38 to the jaw assembly 32 at the first station 42 includes a pair of rollers 134, 136 which are rotatably mounted upon a bracket 138 for rotation about parallel axes. The rollers 134, 136 have peripheral, high-friction surfaces which are positioned in contact with one another so that rotation of one roller 136 in one direction effects a corresponding rotation of the other roller 134 in the opposite direction. As will be apparent herein, the banding material is provided to the dispensing assembly 34 in the form of a strip 142 dispensed from a roll 144, and an end of the strip 142 is routed between the rollers 134, 136. A servomotor 140 is drivingly connected to one of the rollers 136 so that upon actuation of the servomotor 140, the rollers 134, 136 are rotated in directions which advance, or pull, the strip 142 through the rollers 134, 136.

In the depicted dispensing assembly 34, a blade having a radially outwardly-directed cutting edge 146 (FIG. 5) extends across and is embedded within the surface of the roller 136 so that upon rotation of the roller 136 through a single revolution, the blade cutting edge 146 severs the strip 142 in two. Consequently, during a segment-dispensing operation, the servomotor 140 is actuated so that the roller 136 rotates through a single revolution (before stopping) so that one segment 36 of the strip is severed upon completion of that single revolution to a length corresponding to the diameter of the roller 136, the roller 136 is in a "ready" position for dispensing a subsequent segment from the roll 144. For halting the servomotor 140 upon completion of a single revolution, a light-operated encoder 148 is mounted adjacent the roller 134 for sensing the presence of an appropriate indicia borne by the surface of the roller 134 at a selected location therearound and is appropriately wired to the controller 70 so that upon sensing the presence of the roller-borne indicia (corresponding to the rotation of the roller 136 through a single revolution), the servomotor 140 is de-actuated.

To guide the movement of the strip 142 from the rollers 134, 136 to the space between the open clamp members 108, 110 of the clamp assembly 106 and as best illustrated in FIGS. 5 and 6, the banding apparatus 20 is provided with a funnel-like chute 150 which is supported along its sides by an appropriate bracket 151 so as to be disposed in an elevated position above the rollers 134, 136. The chute 150 is provided with an exit end 152 through which the strip 142 exits the chute 150 and is supported at the first station 42 (FIG. 2) and adjacent the jaw assembly 32 so that the exit end 152 is directed toward the space between the open clamp members 108, 110 of the clamp assembly 106. Consequently, as the strip 142 is advanced through the chute 150 by the rollers 134, 136, the leading, or free, end of the strip 142 moves through and out of the exit end 152 of the chute 150 and into position (as illustrated in FIG. 5) at which subsequent movement of the clamp members 108, 110 to a closed condition clamps the clamp members 108, 110 to the jaw assembly 32 for transport to the second station 44 (FIG. 1). Preferably, the rotation of the rollers 134, 136 is halted immediately following severance of a banding material segment 36 from the remainder of the strip 142 so that the trailing end of the segment 36 opposite the leading end thereof remains loosely held between the rollers 134, 136 until the clamp members 108, 110 are closed about the opposite, leading end of the segment 36. This way, the severed segment 36 remains in a stationary position until clamped by the clamp members 108, 110, yet is not so strongly held between the rollers 134, 136 so that following the clamping of the leading end of the segment 36, the trailing end of the segment 36 is easily freed from the rollers 134, 136 as the jaw assembly 32 is lifted from the station 42.

The banding material 38 comprising the strip 142 includes a two-sided strip of paper which has been coated on one side with an adhesive 153 (FIGS. 4 and 5) which must be appropriately treated in order to render the adhesive tacky and thus capable of sticking to a surface with which the adhesive-bearing side of the strip 142 comes into contact. This feature of the strip 142 enables the leading end of the banding material segment 36 to be clamped between the clamp members 108, 110 without the segment 36 adhering to either of the clamp members 108, 110 and further enables the adhesive-bearing side of the strip 142 to be treated locally (i.e. in a preselected region) so as to render the adhesive 153 tacky only in that preselected region in which the adhesive 153 is desired to become tacky. In accordance with the foregoing, the strip 142 is a commercially-available strip of material 38 which bears an adhesive 153 on one side thereof which must be heated to an elevated temperature (e.g. at least about 200° F.) to render the adhesive tacky. In the depicted apparatus 20, the strip 142 is fed to the dispensing assembly 34 from the roll 144 which, in turn, is mounted for rotation upon a horizontally-disposed pin 155 joined to one side of the frame 51 of the apparatus 50. Therefore, as the strip 142 is pulled from the roll 144 by the rollers 134, 136, the roll 144 is permitted to rotate freely about the pin 155.

For purposes of heating the adhesive of the segment 36, there is mounted beneath the worktable 52 of the wrapping apparatus 50 and adjacent the second station 44 a hot-air gun 154 (FIGS. 1, 7 and 10) which is capable of heating air to temperatures of between 240° F. and 290° F. and blowing the heated air toward the segment 36. To this end, the hot-air gun 154 includes an air discharge end 159 (FIG. 10) which is directed toward the location (adjacent the interior of the trough 54) to which the leading end of the segment 36 is positioned following the transport of the segment 36 to the second station 44 with the jaw assembly 32 and release by the clamp assembly 106. With the gun 154 directed toward such a location, the adhesive 153 borne by the leading end of the segment 36 is exposed to the heated air directed out of the discharge end of the gun 154. The hot-air gun 154 is appropriately wired to the controller 70 for receiving operating power therefrom.

Figure 13:
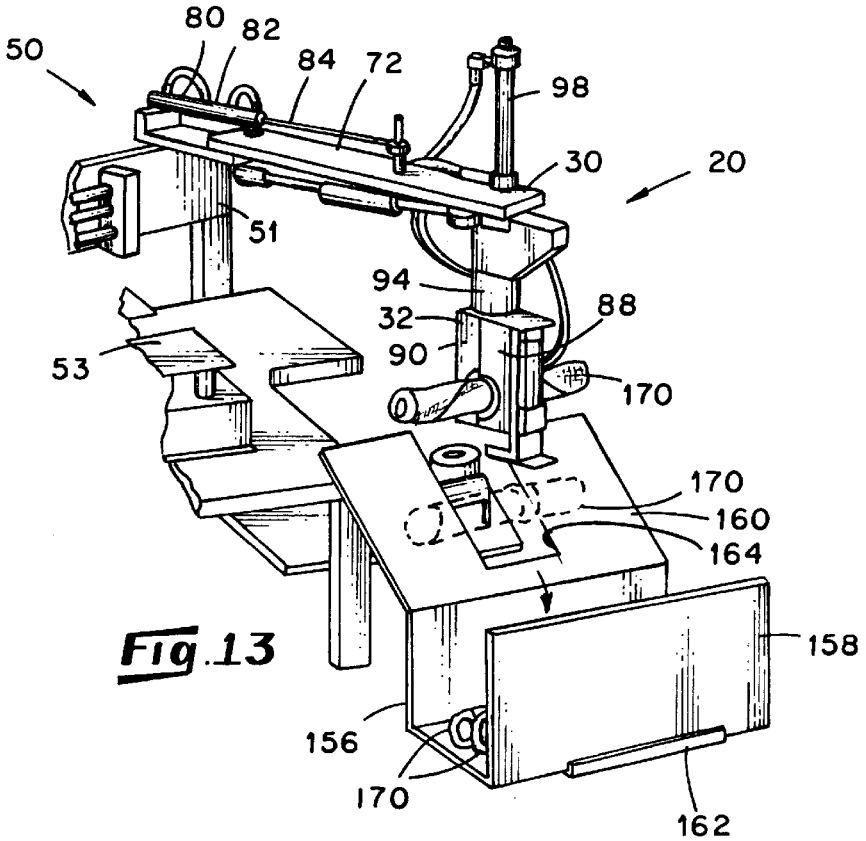
FIG. 13 is a perspective view of a fragment of the silverware wrapping apparatus and banding apparatus of FIG. 1 illustrating a banded silverware arrangement which has been carried to the one station of the FIG. 1 apparatus by the jaw assembly of the apparatus.

With reference to FIGS. 1, 7 and 13, the banding apparatus 20 also includes a collection receptacle 156 supported adjacent the first station 42 for collecting banded silverware arrangements (indicated 170 in FIGS. 1 and 13) deposited therein from the jaw assembly 32. In this connection, the collection receptacle 156 includes an open-topped bin portion 158 of substantially U-shaped cross section and an angularly-disposed guideway 160 joined to one (side) leg of the U of the bin portion 156 at the upper end thereof. As best shown in FIG. 4, the receptacle 156 is removably supported upon a bracket 162 extending from the apparatus frame 51, and its guideway 160 defines a cutout 164 which spans the width of the exit end of the chute 150 of the dispensing assembly 34. As will be apparent herein, the cutout 164 accommodates the upward and downward movement of the jaw assembly 32 into and out of working relationship with the dispensing assembly 34, while the portions of the guideway 160 disposed on opposite sides of the cutout 164 provide a guideway surface upon which the banded silverware arrangements 170 can be dropped from the jaw assembly 34 and gravitationally guided downwardly therealong (as illustrated in FIG. 13) into the bin portion 158 of the receptacle 156.

At the outset of a silverware wrapping and banding operation performed with the wrapping apparatus 50 and banding apparatus 20, the napkin pick-up means 48 is positioned in a "ready" position (as illustrated in FIG. 1) disposed above the napkin storage bin 53 and the jaw members 88, 90 of the jaw assembly 32 are positioned in an open condition and disposed in an elevated position above the banding material dispenser assembly 34. Upon initiation of a wrapping/banding operation, a napkin 24 is picked up from the storage bin 53 and transported to the worktable 52 where it is released and permitted to cover the upwardly-directed opening of the trough 54. With the napkin 24 positioned across the trough 54, items 18 of silverware are released from the silverware storage bins 55 and are gravitationally directed onto the napkin 24 where the items 18 are permitted to fall into the trough 54 so that the napkin 24 is disposed between the bottom of the trough 54 and the overlying silverware items 18. At that point, the rotatable blades 56 disposed along one side of the trough 54 are rotated through several (e.g. three) revolutions about the longitudinal axis of the trough 54 so that the napkin 24 and silverware items 18 are wound together into a tightly-wound arrangement 22 (FIG. 2).

While the silverware wrapping operation is being performed with the wrapping apparatus 50, the jaw assembly 34 and the clamp assembly 106, while maintained in the open conditions, are lowered to the dispenser assembly 34 at the first station 42 (as depicted in FIG. 5) for accepting the end of a banding material segment 36 dispensed from the roll 144 of banding material. With the jaw assembly 34 positioned in this lowered, FIG. 5 position, the strip 142 of banding material is advanced between the rollers 134, 136 by way of the servomotor 140 so that one end (i.e. the leading end) of the strip 142 is directed between the open clamp members 108, 110 of the clamp assembly 106 to the position of the segment 36 shown in FIG. 5. As mentioned earlier, the servomotor 140 is actuated so that the roller 136 rotates through a single revolution thereby advancing the strip 142 of the banding material 38 from the roll 144 and through the chute 150 and so that the blade cutting edge 146 severs the banding material strip 146 to a desired length (corresponding to the circumference of the roller 138) to form the segment 36.

With the leading end of the banding material segment 36 positioned within the open clamp assembly 106 as shown in FIG. 5, the cylinder assembly 116 is actuated to close the clamp assembly 106 and thereby secure the banding material segment to the jaw assembly 32. With the banding material segment 36 secured to the jaw assembly 32 in this manner, the jaw assembly 32 is returned to the raised position above the dispensing assembly 34 (i.e. to the FIG. 4 phantom-line position) by appropriate actuation of the cylinder assembly 98. The jaw assembly 34 is then moved horizontally across the apparatus 50 by way of the cylinder assembly 80 (FIGS. 1 and 7) and arm member 72 to the position illustrated in FIG. 7 above the worktable 52 at which the jaw assembly 32 is disposed substantially in registry with the upwardly-opening trough 54. As mentioned earlier, the linkage member 73 cooperates with the arm member 72 as the arm member 72 is moved horizontally from the FIG. 1 position above the first station 42 to the FIG. 2 position above the second station 44 so that upon reaching the second station 44, the jaw assembly 32 has been rotated in position about a vertical axis through about 180° of movement to the position illustrated in FIG. 1. With the jaw assembly 32 positioned above the second station 44 and as best shown in FIG. 8, the segment 36 is held by the clamping assembly 106 so that the segment 36 substantially spans the opening of the trough 54 and the wrapped silverware arrangement 22 lying therein. It follows that by the time that the jaw assembly 32 reaches the FIG. 8 position, the silverware wrapping operation has been completed by the apparatus 50, although the rotatable blades 56 have not yet been withdrawn lengthwise from the working relationship with the napkin 24 wrapped within the trough 54.

When the jaw assembly 32 reaches the FIG. 1 position at which the jaw members 88, 90 are in disposed above the opening of the trough 54, the jaw assembly 32 is lowered by the cylinder assembly 98 until the jaw members 88 and 90 are disposed on opposite sides of the wrapped silverware arrangement 22 as shown in FIG. 9. As mentioned earlier, the cut-out 60 provided in the worktable 52 accommodates the downward movement of the jaw assembly 34 to its operative (FIG. 9) position about the wrapped silverware arrangement 22 disposed within the trough 54. It also follows that as the jaw members 88, 90 are lowered to this FIG. 9 position, the segment 36 of the banding material which is held at one end by the clamping assembly 106 is lowered across the wrapped silverware arrangement 22 so that the banding material segment 36 spans the wrapped silverware arrangement 22 in the inverted U orientation illustrated in FIG. 9 and is held across the arrangement 22 in this inverted U orientation by the jaw members 88, 90 against the force of any inherent biasing, or elastic tendency, of the opposite ends of the segment 36 to curl upwardly. The jaw assembly 32 is then closed about the wrapped silverware arrangement 22 by appropriate actuation of the air clamp 94 to the position illustrated in FIG. 10 at which the wrapped arrangement 22 is loosely captured within the opening, indicated 172, formed by the collective Cs of the jaw members 88, 90. At that point, the cylinder assembly 116 is de-actuated so that the clamp assembly 106 opens and thereby releases the leading end of the banding material segment 36. By releasing the end of the banding material segment 36 as aforedescribed, the adhesive 153 borne by the released end is exposed to the discharge end of the hot-air gun 154 as illustrated in FIG. 10. It follows that the side of the segment 36 which bears the heat-treatable adhesive is the side of the segment 36 which is disposed generally downwardly when the segment 36 is held by the clamp assembly 106 in the manner illustrated in FIG. 8.

Figure 11:
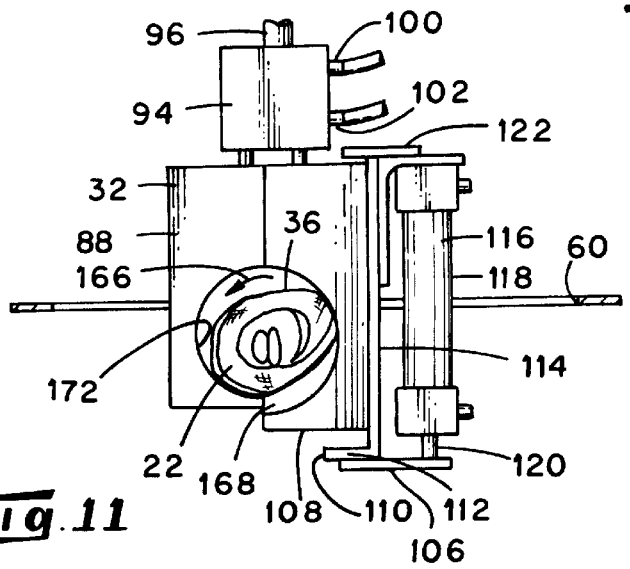
Figure 12:
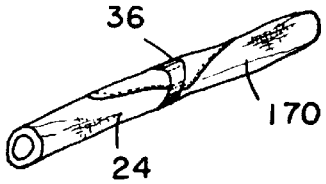
FIG. 12 is a perspective view of a wrapped silverware arrangement which has been banded by the FIG. 1 apparatus.

The hot air gun 154 is thereafter turned ON to heat-treat the adhesive 153 borne by the exposed surface of the banding material segment 36 and thereby render the adhesive tacky. Upon completion of this adhesive-treating step (and while the adhesive remains tacky) the rotatable blades 56 (which have remained in working relationship with the wrapped silverware arrangement 22 within the trough 54) are again rotated (e.g. through a single revolution) about the longitudinal axis of the trough 54 so that the wrapped silverware arrangement 22 is again wound within the trough 54. This rotation of the wrapped arrangement 22 forces the band segment 36 to be rotated with the arrangement 22 in the direction of the arrow 166 of FIG. 11 (due to the consequential frictional engagement between the surface of the napkin 24 and that of the band segment 36) so that the tacky end of the segment 36 is pulled between the jaw members 88, 90 and contacts so as to adhere to the side of the segment 36 opposite the adhesive-bearing side—thereby causing the segment 36 to stick to itself in a banded condition about the wrapped arrangement 22 to form the banded silverware arrangement 170 of FIG. 12. As best shown in FIG. 11, a small gap 168 exists between the jaw members 88, 90 at the lower ends thereof through which the heated end of the segment 36 is permitted to be pulled into the opening 172 provided between the jaw members 88, 90 by the rotation of the wrapped silverware arrangement 22.

With the banding material segment 36 secured about the wrapped silverware arrangement 22 in the aforedescribed manner to form the banded silverware arrangement 170, the jaw assembly 34 (with its jaw members 88, 90 remaining in the closed condition about the banded arrangement 170) is raised from the trough 54 (by way of the cylinder assembly 98) to the elevated condition above the trough 54 so that the banded silverware arrangement 170 is raised with the jaw members 88, 90 to the elevated position. The cylinder assembly 80 of the arm-moving means 76 is then actuated to swing the jaw assembly 34 horizontally from the position of vertical registry with the second station 44 to the elevated position above the first station 42 at which the jaw assembly 34 and the banded silverware arrangement 170 held thereby are disposed above the guideway 160 of the collection receptacle 156. The jaw members 88, 90 are then moved to the open position (by de-actuation of the air clamp 94) so that the banded silverware arrangement 170 is permitted to fall from between the jaw members 88, 90 and onto the guideway 160 whereupon the banded silverware arrangement 170 is permitted to be gravitationally directed by the guideway 160 into the bin portion 158 of the receptacle 156. The banded silverware arrangements 170 collected within the bin portion 158 can subsequently be taken (e.g. manually) from the bin portion 158 for use at table settings. Furthermore, with each of the jaw assembly 32 and clamp assembly 106 positioned in its open condition above the first station 42, the apparatus 20 is in condition for initiation of a subsequent silverware banding operation.

As mentioned earlier, the sequence of operation of the various components (including cylinder assembly valves and motors) of the wrapping apparatus 20 and the banding apparatus 50 are controlled by a computer controller 70 disposed below the worktable 52 and suitably wired to the various components. Furthermore, the sequence of operation of the banding apparatus 20 involving the pick-up and transport of the banding material segment 36 from the dispenser assembly 34 to the second station 44 is coordinated with the positioning of a napkin 24 and silverware items 18 within the worktable trough 54 so that by the time that the napkin 24 and silverware items 18 have been wound into a wound arrangement by the rotating blades 56, the jaw assembly 32, along with the banding material segment 36 held by the clamp assembly 106, is in its FIG. 7 position for lowering from its elevated condition onto the wrapped silverware arrangement 22 disposed within the trough 54. Similarly, the removal of the banded silverware arrangement 170 from the trough 54 and the subsequent transport of the arrangement 170 to the collection receptacle 156 can be coordinated with the initiation a subsequent napkin-wrapping cycle of operation. Consequently, operations of the wrapping apparatus 50 and the banding apparatus 20 are performed automatically and relatively quickly.

It follows from the foregoing that an apparatus and method has been described for banding silverware items which have been previously wrapped within a napkin 24. The apparatus 20 includes jaw members 88, 90 which are movable between opened and closed conditions and a clamp assembly 106 which is joined to the jaw members 88, 90 for releasably holding one end of a segment 36 of banding material so that the remainder of the banding material segment 36 spans the mouth of the jaws members 88, 90 when in the opened condition (as best shown in FIG. 8). While the jaw members 88, 90 and clamp assembly 106 are arranged in the open condition and positioned at a first station, one end of a segment 36 of banding material is advanced into a position between the clamp members of the clamping assembly 106, and the clamping assembly 106 is closed to secure the one end of the segment 36 adjacent the jaw members 88, 90. The jaw members 88, 90 are subsequently transported by suitable moving means 76 to a second station 44 at which the jaw members 88, 90 are lowered onto a wrapped silverware arrangement 22 so that the segment 36 of banding material is lowered across the arrangement 22 to form an inverted U thereover. The jaw members 88, 90 are then moved to a closed condition to loosely position the jaw members 88, 90 about the wrapped silverware arrangement 22, and the one end of the banding material segment 36 held within the clamp assembly 106 is subsequently released to expose the one end of the segment 36 to treatment (e.g. heat-treatment) which renders the adhesive 153 borne on one side of the banding material segment 36 tacky. While the segment-borne adhesive 153 is in a tacky condition, the wrapped silverware arrangement 22 is rotated about its longitudinal axis while loosely captured between the jaw members 88, 90 so that the banding material segment 36, because of the resultant contact between the tacky adhesive 153 of the segment 36 and the opposite, non-adhesive-bearing side of the segment 36, the segment 36 adheres to itself in a band wound about the wrapped arrangement 22. The jaw members 88, 90, while still in the closed condition, are subsequently removed from the second station 44 and moved to a location (e.g. above the first station 42) at which the jaw members 88, 90 are opened and thereby permit the banded silverware arrangement 170 to drop into a collection receptacle 156 for collection.

Figure 15:
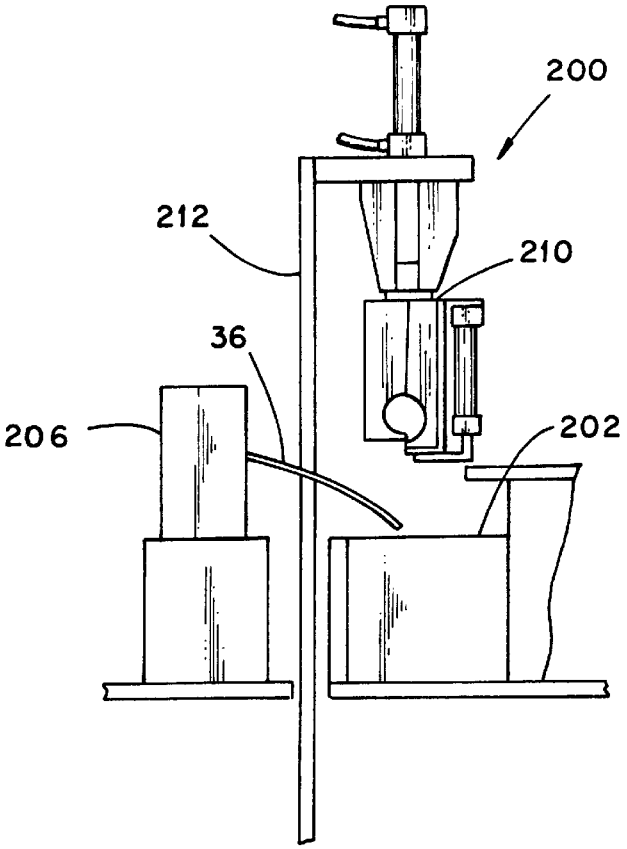
FIG. 15 is an end view of the FIG. 14 embodiment as seen generally from the right in FIG. 1 illustrating the jaw assembly of the FIG. 14 embodiment.
Figure 14:
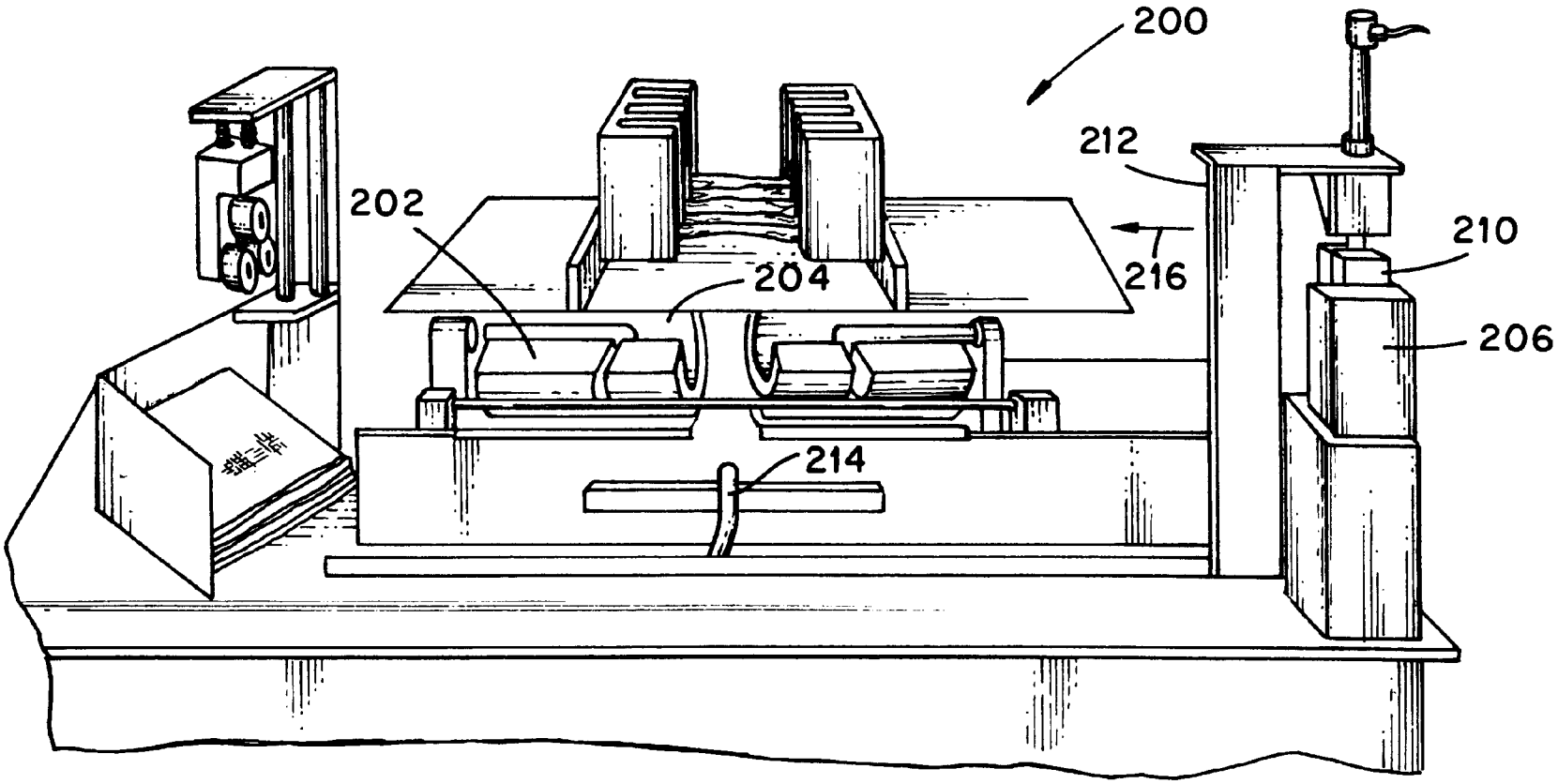
FIG. 14 is a frontal perspective view of a fragment of an alternative embodiment of a silverware wrapping arrangement.

It will be understood that numerous modifications and substitutions can be had to the aforedescribed embodiments without departing from the spirit of the invention. For example, although the apparatus 20 has been shown and described as including arm-moving means 76 disposed above the worktable 52 for bodily shifting the jaw assembly 32 between the first station 42 (at which the banding material segment 38 is clamped to the jaw assembly 32) and the second station 44 (at which the jaw assembly 32 is in vertical registry with the worktable trough 54), an apparatus in accordance with the apparatus of the present invention can include jaw-moving means which are mounted beneath the worktable 52. For example, there is shown in FIGS. 14 and 15 a napkin wrapping and banding apparatus 200 having a worktable 202 and trough 204 at which a napkin is wound about items of silverware and a stationary dispensing assembly 206 from which a segment 36 of banding material is dispensed from a roll to a jaw assembly 210. In the apparatus 200, the jaw assembly 210 is mounted upon a pedestal 212 which is supported for movement (for example, in the direction indicated by the FIG. 14 arrow 216) from the dispensing assembly 206 to a position above the worktable trough 204. Means for moving the pedestal 212 between the dispensing assembly 206 and the trough 204 are mounted beneath the worktable 202 and are adapted to move the pedestal 212 along a linear path as the pedestal 212 (with the jaw assembly 210 supported thereby) is moved between the assembly 206 and the trough 204.

Further still, although the aforedescribed apparatus 20 has been shown and described as including a hot-air gun 154 for applying heat to the adhesive 153, the apparatus 200 of FIG. 14 utilizes a tube 214 mounted adjacent the worktable trough 204 for directing the flow of hot air from a source toward the interior of the trough 204 where an end of a banding material segment is exposed to hot air exiting the tube 214. Moreover, an apparatus in accordance with the broader aspects of the invention can include a source of radiant heat for supplying heat to the adhesive, or other means (such as a water spray), to render the adhesive tacky.

Yet still further, although the aforedescribed embodiments have been shown and described as units which automatically wrap and band a napkin about silverware without intervention by a user, a banding apparatus according to the present invention can be a stand-alone unit to which wrapped napkins are brought, and at which the wrapped napkins are automatically banded. Such a stand-alone unit includes a jaw assembly into which wrapped arrangements are placed one-at-a-time by an operator and means for rotating the jaw assembly (after it has been closed about the wrapped arrangement) about the longitudinal axis of the wrapped arrangement through about ninety angular degrees (as the arrangement is held in a stationary condition) to wind and seal the banding segment about the wrapped arrangement. Accordingly, the aforedescribed embodiments are intended for the purpose of illustration and not as limitation.

What is claimed is:

1. An apparatus for banding a wrapped silverware arrangement with a two-sided segment of banding material bearing an adhesive on one side thereof which requires appropriate treatment in order that the adhesive is rendered tacky and thereby capable of adhering to a surface against which the adhesive-bearing side of the segment is placed into contact, and wherein the wrapped silverware arrangement includes at least one item of silverware which has been wound within a napkin into a wrapped arrangement of elongated form, the apparatus comprising:

a frame;

a jaw assembly supported by the frame and including opposing jaw members which are joined together to accommodate movement of the jaw members relative to one another between an open condition at which the jaw members define an open mouth through which the wrapped silverware arrangement can be moved sideways into a position between the jaw members and a closed condition at which the wrapped silverware arrangement is captured between the jaw members in a manner which permits the wrapped arrangement to be rotated about its longitudinal axis while in a captured condition between the jaw members;

means connected to the jaw assembly for moving the jaw members between the open and closed conditions;

clamp means joined to the jaw assembly for releasably holding a segment of banding material adjacent the jaw assembly including opposing clamp members which are movable toward and away from one another between an open condition at which an end of the banding material segment can be accepted between the clamp members and a closed condition at which the end of the banding material segment is clamped therebetween;

means for moving the clamp members of the clamp means between the open and closed conditions;

means disposed at a first station for introducing an end of the banding material segment between the clamp members when the clamp members are in the open condition so that by subsequently moving the clamp members to the closed condition, the end of the banding material segment is held between the clamp members;

means for moving the jaw assembly, with its jaw members arranged in the open condition and one end of a banding material segment held between the clamp members, from the first station and onto the wrapped silverware arrangement so that the banding material segment is draped across the wrapped silverware arrangement and so that subsequent movement of the jaw members to the closed condition captures the silverware arrangement between the jaw members and positions the banding material segment in a U-shaped arrangement about the wrapped silverware arrangement and the release of the banding segment by the clamp members places the one end of the banding material segment in an exposed condition; and means for treating a region of adhesive borne by one side of the exposed end of the banding material segment to render the adhesive of the region tacky and so that subsequent rotation of the wrapped silverware arrangement about its longitudinal axis moves the tacky region of adhesive into contact with another surface region of the banding material segment so that the banding material segment is secured to itself in a band about the wrapped silverware arrangement.

2. The apparatus as defined in claim 1 wherein the banding material is provided to the introducing means from a strip of banding material, and the means for introducing includes at least one rotatable roller positioned in engagement with the opposite sides of the strip of banding material, and means for rotating the at least one roller about an axis so that a segment of banding material is advanced along the surface of the at least one roller into position between the clamp members.

3. The apparatus as defined in claim 2 wherein the introducing means includes means for severing the segment of banding material as the segment is being advanced along the surface of the at least one roller.

4. The apparatus as defined in claim 1 wherein each jaw member includes an engagement surface of substantially C-shaped cross section and the jaw members are arranged so that the C-shaped surfaces thereof open generally toward one another so that when the jaw members are moved to the closed condition, the C-shaped surfaces collectively provide an opening within which the wrapped silverware arrangement is captured by the jaw members.

5. The apparatus as defined in claim 1 wherein each of the means for moving the jaw members between open and closed conditions and the means for moving the clamp members of the clamping assembly between open and closed conditions includes an air-actuated cylinder assembly.

6. The apparatus as defined in claim 1 wherein the wrapped napkin arrangement is situated at a second station which is disposed laterally from the first station, and the means for moving the jaw assembly from the first station includes means for moving the jaw assembly upwardly from the introducing means and then laterally into vertical registry with the second station and then downwardly about the wrapped silverware arrangement so that the jaw members are disposed on opposite sides of the wrapped silverware arrangement.

7. The apparatus as defined in claim 1 wherein the adhesive borne on the one side of the banding material segment is rendered tacky when heated to an elevated temperature, and the treating means includes means for applying heat to the region of adhesive borne by the one side of the banding material segment to render the adhesive of the region tacky.

8. An apparatus for banding a wrapped silverware arrangement with a two-sided segment of banding material taken from a roll of banding material and wherein the banding material bears an adhesive on one side thereof which requires appropriate treatment in order that the adhesive is rendered tacky and thereby capable of adhering to a surface against which the adhesive-bearing side of the segment is placed into contact, and wherein the wrapped silverware arrangement includes at least one item of silverware which has been wound within a napkin into a wrapped arrangement of elongated form, the apparatus comprising:

a frame including means providing a first station and a second station, and wherein the wrapped silverware arrangement is positioned at the second station;

a jaw assembly supported by the frame and including opposing jaw members which are joined together to accommodate movement of the jaw members relative to one another between an open condition at which the jaw members define an open mouth which enables the jaw members to be lowered across the wrapped silverware arrangement arranged sideways with respect to the open mouth so that the wrapped silverware arrangement is positioned between the jaw members and a closed condition at which the wrapped silverware arrangement is captured between the jaw members in a manner which permits the wrapped arrangement to be rotated about its longitudinal axis while in its captured condition;

means connected to the jaw assembly for moving the jaw members between the open and closed conditions;

means associated with the frame for supporting a roll of banding material for rotation about an axis;

clamp means joined to the jaw assembly for releasably holding a segment of banding material adjacent the jaw assembly including opposing clamp members which are movable toward and away from one another between an open condition at which an end of the banding material segment can be accepted between the clamp members and a closed condition at which the end of the banding material segment is clamped therebetween;

means for moving the clamp members of the clamp means between the open and closed conditions;

means disposed at the first station for introducing an end of the banding material segment from the roll of banding material and into a position between the clamp members when the clamp members are in the open condition so that by moving the clamp members to the closed condition while the one end of the banding material segment is positioned between the clamp members, the end of the banding material segment is held between the clamp members;

means for moving the jaw assembly, while its jaw members are arranged in the open condition and one end of a banding material segment is held between the clamp members, from the first station and onto the wrapped silverware arrangement at the second station so that movement of the jaw members about the wrapped silverware arrangement drapes the banding material segment across the wrapped silverware arrangement and so that subsequent movement of the jaw members to the closed condition captures the silverware arrangement between the jaw members and positions the banding material segment in a U-shaped arrangement about the wrapped silverware arrangement and the release of the banding segment by the clamp members places the one end of the banding material segment in an exposed condition; and means supported adjacent the second station for treating a region of adhesive borne by one side of the exposed end of the banding material segment to render the adhesive of the region tacky; and means disposed adjacent the second station for rotating the wrapped silverware arrangement about its longitudinal axis so that the tacky region of adhesive is moved into contact with another surface region of the banding material segment so that the banding material segment is secured to itself in a band about the wrapped silverware arrangement to form a banded silverware arrangement.

9. The apparatus as defined in claim 8 further including a collection receptacle for accepting a banded silverware arrangement deposited therein, and the means for moving the jaw assembly from the first station to the second station is adapted to transport the banded silverware arrangement, while the banded silverware arrangement remains captured between the jaw members, from the second station to a position disposed generally above the collection receptacle so that subsequent movement of the jaw members to the open condition permits the banded silverware arrangement to be gravitationally directed into the collection receptacle.

10. The apparatus as defined in claim 8 wherein the apparatus includes means defining a trough at the second station, the wrapped silverware arrangement is positioned within the trough, and the means for rotating the wrapped silverware arrangement about its longitudinal axis includes a pair of rotatable blades which are disposed along one side of the trough for rotation about the longitudinal axis of the trough so that rotation of the blades about the longitudinal axis of the trough effects the rotation of the wrapped silverware arrangement about its longitudinal axis, and the apparatus further includes means for withdrawing the blades longitudinally of the trough upon completion of a silverware-banding operation.

11. A method for banding a wrapped silverware arrangement with a two-sided segment of banding material bearing an adhesive on one side thereof which requires appropriate treatment in order that the adhesive is rendered tacky and thereby capable of adhering to a surface against which the adhesive-bearing side of the segment is placed into contact, and wherein the wrapped silverware arrangement includes at least one item of silverware which has been wound within a napkin into a wrapped arrangement of elongated form, the method comprising the steps of:

providing a jaw assembly including opposing jaw members which are joined together to accommodate movement of the jaw members relative to one another between an open condition at which the jaw members define an open mouth through which the wrapped silverware arrangement can be moved sideways into a position between the jaw members and a closed condition at which the wrapped silverware arrangement is captured between the jaw members in a manner which permits the wrapped arrangement to be rotated about its longitudinal axis while in its captured condition;

providing the jaw assembly with clamp means for releasably holding a segment of banding material adjacent the jaw assembly including opposing clamp members which are movable toward and away from one another between an open condition at which an end of the banding material segment can be accepted between the clamp members and a closed condition at which the end of the banding material segment is clamped therebetween;

introducing an end of the banding material segment between the clamp members at a first station when the clamp members are in the open condition and subsequently moving the clamp members to the closed condition so that the end of the banding material segment is held between the clamp members;

moving the jaw assembly, while its jaw members are arranged in the open condition and one end of a banding material segment is held between the clamp members, from the first station to a second station at which the jaw assembly is moved onto the wrapped silverware arrangement so that the banding material segment is draped across the wrapped silverware arrangement;

subsequently moving the jaw members to the closed condition so that the silverware arrangement is captured between the jaw members and the banding material segment is positioned in a U-shaped arrangement about the wrapped silverware arrangement and then moving the clamp members to the open condition to release the banding segment from the clamp members and thereby place the one end of the banding material segment in an exposed condition; and treating a region of adhesive borne by one side of the exposed end of the banding material segment to render the adhesive of the region tacky; and subsequently rotating the wrapped silverware arrangement about its longitudinal axis so that the tacky region of adhesive is moved into contact with another surface region of the banding material segment so that the banding material segment is secured to itself in a band about the wrapped silverware arrangement.

12. The method as defined in claim 11 further including a step of providing a collection receptacle for accepting banded silverware arrangement deposited therein, and the step of rotating the wrapped silverware arrangement about its longitudinal axis means is followed by the steps of transporting the banded silverware arrangement, while the banded silverware arrangement remains captured between the jaw members, from the second station to a position disposed generally above the collection receptacle; and subsequently moving the jaw members to the open condition to permit the banded silverware arrangement to be gravitationally directed into the storage receptacle.

13. The method as defined in claim 11 wherein the banding material is fed from a roll of banding material, and the step of introducing includes the steps of:

positioning a pair of rotatable rollers in contact with the opposite sides of a strip of banding material leading from a roll of banding material; and rotating at least one of the rollers about an axis so that a segment of banding material is pulled from the roll and advanced between the rollers toward the clamp members.

14. The method as defined in claim 13 wherein the step of rotating the at least one of the rollers is accompanied by a step of severing the segment of banding material from the remainder of the roll.

* * * * *